US006446552B1

(12) United States Patent
Takahashi

(10) Patent No.: US 6,446,552 B1
(45) **Date of Patent: *Sep. 10, 2002**

(54) STENCIL MAKING APPARATUS AND METHOD

(75) Inventor: Junji Takahashi, Amimachi (JP)

(73) Assignee: Riso Kagaku Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/505,847

(22) Filed: Feb. 17, 2000

(30) Foreign Application Priority Data

Feb. 17, 1999 (JP) ..... 11-038289

(51) Int. Cl.[7] ..... B41C 1/14
(52) U.S. Cl. ..... 101/128.4; 101/401.1
(58) Field of Search ..... 101/128.21, 128.4, 101/401.1, 467

(56) References Cited

U.S. PATENT DOCUMENTS 2,903,510 A * 9/1959 Elliott ..... 101/128.4
3,006,992 A * 10/1961 Nakagawa et al. ..... 101/128.4
3,113,511 A * 12/1963 Dalton ..... 101/128.4
3,374,311 A * 3/1968 Hell ..... 101/401.1
4,086,853 A * 5/1978 Figov et al. ..... 101/467
4,347,785 A * 9/1982 Chase et al. ..... 101/401.1
4,443,820 A * 4/1984 Mutoh et al. ..... 101/401.1
5,558,019 A * 9/1996 Kawai et al. ..... 101/128.4

FOREIGN PATENT DOCUMENTS

JP 9-18662 1/1997

* cited by examiner

*Primary Examiner*—Stephen R. Funk
(74) *Attorney, Agent, or Firm*—Nixon Peabody LLP; Donald R. Studebaker

(57) ABSTRACT

A stencil making apparatus having a single conveyance section, a reading section which reads an original to obtain data during conveyance of the original, and a stencil making section which perforates a stencil sheet during conveyance of the stencil sheet, based on the data read by the reading section. The reading section and the stencil making section are juxtaposed on the single conveyance section, and the conveyance of the original to the reading section and the conveyance of the stencil sheet to the stencil making section are performed by the single conveyance section.

7 Claims, 3 Drawing Sheets

PRIOR ART

STENCIL MAKING APPARATUS AND METHOD

BACKGROUND OF THE INVENTION

1. Field of the Invention

This invention relates to a stencil making apparatus and a stencil making method, and more particularly to an apparatus and a method which make a perforated stencil sheet, based on data read from an original.

2. Description of the Related Art

For example, in a digital stencil printer with a stencil making apparatus, an original is read with reading means, and based on the read data, a perforated stencil sheet is made with stencil making means. The perforated stencil sheet is wound around the outer peripheral surface of a printing drum in a printing section, and this printing drum is driven to rotate. Between the printing drum and a press roller which rotates in contact with this drum, printing paper is inserted. Ink inside the printing drum is pushed out to the printing paper through the perforated stencil sheet, whereby ink transfer is performed.

In general, the above-mentioned stencil making apparatus includes reading means 61 which has a line image sensor (hereinafter referred to simply as an image sensor) and stencil making means 62 which has a line thermal print head (hereinafter referred to simply as a thermal head), as shown in FIG. 6. The reading means 61 reads an original 64 being conveyed in the direction of an arrow by a conveyor roller 63 line by line in sequence by an image sensor (a contact type or a reduced optical type) and obtains read data (image data). The read data is sent to an image processing board 65, and image processing is performed. The stencil making means 62 drives the thermal head in accordance with the image-processed data, and a stencil sheet 67 being conveyed in the direction of an arrow by a conveyor roller 66 is perforated by the above-mentioned thermal head. The conveyor rollers 63, 66 are respectively driven to rotate by exclusive drive motors (not shown).

The conventional stencil making apparatus, however, has the disadvantage that conveyor rollers and drive motors both have to be provided two by two and therefore the apparatus increases in size and becomes expensive, since the reading means 61 and the stencil making means 62 are individually provided with the separate conveyor rollers 63, 66 and also the conveyor rollers 63, 66 are respectively provided with exclusive drive motors, as described above.

In addition, because the reading means and the stencil making means convey an original and a stencil sheet by separate drive motors and conveyor rollers, there are cases where there is a difference in speed (difference in an amount of conveyance) between the speed of conveying the original through the reading means and the speed of conveying the stencil sheet through the stencil making means. In such a case, there is a difference between the timing at which data is read from the original and the timing at which the stencil sheet is perforated, and consequently, there is a problem that the stencil sheet cannot be perforated as indicated by the original.

SUMMARY OF THE INVENTION

In view of the foregoing observations and description, an object of the present invention is to provide a stencil making apparatus and a stencil making method which are small in size, light in weight and inexpensive by employing single conveying means. Another object of the invention is to provide a stencil making apparatus and a stencil making method in which a difference in timing due to an electric breakdown or surrounding vibrations will not occur between the timing at which data is read from the original and the timing at which the stencil sheet is perforated.

To achieve the aforementioned objects, there is provided a stencil making apparatus comprising single conveyance means, reading means which reads an original to obtain data during conveyance of the original, and stencil making means which perforates a stencil sheet during conveyance of the stencil sheet, based on the data read by the reading means, wherein the reading means and the stencil making means are juxtaposed on the single conveyance means, and the conveyance of the original to the reading means and the conveyance of the stencil sheet to the stencil making means are performed by the single conveyance means.

The expression "he reading means and the stencil making means are juxtaposed on the single conveyance means" is intended to mean that the reading means and the stencil making means are disposed on the single conveyance means so that the conveyance of the original through the reading means during original reading and the conveyance of the stencil sheet through the stencil making means during stencil making can be performed by the single conveyance means.

In the stencil making apparatus, the reading means and the stencil making means are juxtaposed on the single conveyance means, and the conveyance of the original to the reading means and the conveyance of the stencil sheet to the stencil making means are performed by the single conveyance means. With this arrangement, only single conveyance means is required and also only single drive means for driving the conveyance means is required. Accordingly, the size, weight, and cost of the entire apparatus can be reduced.

In the stencil making apparatus, the conveyance means may be a conveyor roller, and the reading means and the stencil making means may be juxtaposed in an axial direction of the conveyor roller.

The "conveyance means" may be any means if it is able to convey an original and a stencil sheet and therefore the conveyance means is not limited to the conveyor roller.

In addition, in the stencil making apparatus, the reading means and the stencil making means may be pushed against the conveyor roller with different pressures, respectively. The reading-means corresponding portion of the conveyor roller which is pushed against the reading means and the stencil-making-means corresponding portion of the conveyor roller which is pushed against the stencil making means may differ in their constituent element, such as material, diameter and the like, in such a manner that the original and the stencil sheet can be conveyed at the same speed.

The expression "the original and the stencil sheet can be conveyed at the same speed" means that a difference in the conveying speed between the two becomes smaller compared with the case where the reading-means corresponding portion and stencil-making-means corresponding portion of the conveyor roller are exactly the same in construction.

Since only one conveyance means is provided, an original and a stencil sheet can be conveyed at the same time by the conveyance means, and original reading and stencil making can be performed at the same time. Therefore, even if a variation in the conveying speed occurs due to an electric breakdown or surrounding vibrations, no difference in speed will occur between the speeds of conveying the original and the stencil sheet and therefore the stencil sheet can be perforated as indicated by the original.

In many cases, the optimum pressures of the reading means and the stencil making means against the conveyor roller differ in order to perform satisfactory original reading and stencil making. The surface of the conveyor roller is usually constituted by an elastic body. If the reading means and the stencil making means are pushed with different pressures, when the conveyor roller is constructed uniformly, the outside diameters of the reading-means corresponding portion and stencil-making-means corresponding portion of the conveyor roller will differ. That is, the contraction amount of the elastic body of the portion pushed with greater pressure is greater. For this reason, the speeds of conveying the original and the stencil sheet differ, and consequently, stencil making will not be synchronized with original reading. However, in the stencil making apparatus of the present invention, a difference between the timing at which stencil making is performed and the timing at which original reading is performed can be reduced, because the outside diameters of the reading-means corresponding portion and stencil-making-means corresponding portion of the conveyor roller differ in constituent element, such as material, diameter and the like, in such a manner that the original and the stencil sheet can be conveyed at the same speed.

In accordance with the present invention, there is a stencil making method comprising the steps of juxtaposing reading means and stencil making means on single conveyance means, conveying an original to the reading means and a stencil sheet to the stencil making means at the same time by the single conveyance means, reading the original to obtain data during the conveyance of the original by the reading means, and perforating the stencil sheet during the conveyance of the stencil sheet by the stencil making means, based on the data read by the reading means.

Therefore, as with the above-mentioned stencil making apparatus, a difference in the conveying speed between the original and the stencil sheet can be eliminated and the stencil sheet can be perforated as indicated by the original.

DESCRIPTION OF THE PREFERRED EMBODIMENTS

A preferred embodiment of a stencil making apparatus according to the present invention will hereinafter be described in detail with reference to FIGS. 1 to 4.

As shown in FIGS. 1 to 4, the stencil making apparatus comprises a conveyor roller (conveyance means) 1, reading means 2 and stencil making means 3 juxtaposed on the conveyor roller 1 in the axial direction of the conveyor roller 1, a printed-circuit board 4, and a pulse motor (drive means) 5 which drives the conveyor roller 1 to rotate.

Figure 1:
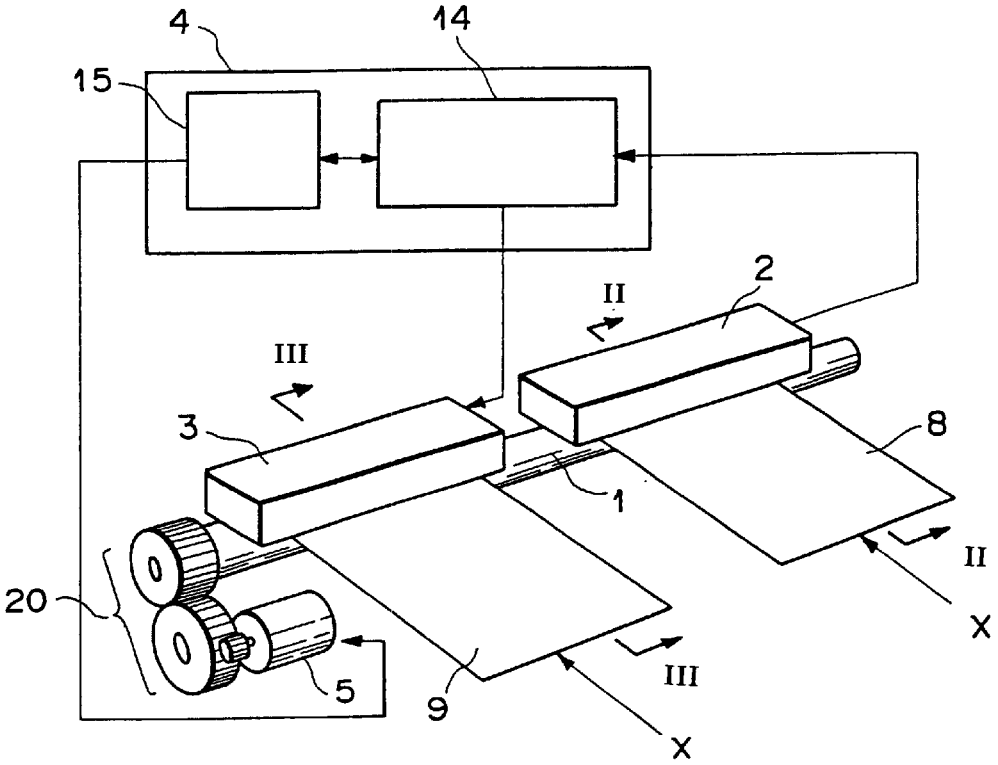
FIG. 1 is a perspective view showing the construction of a stencil making apparatus according to an embodiment of the present invention.
Figure 2:
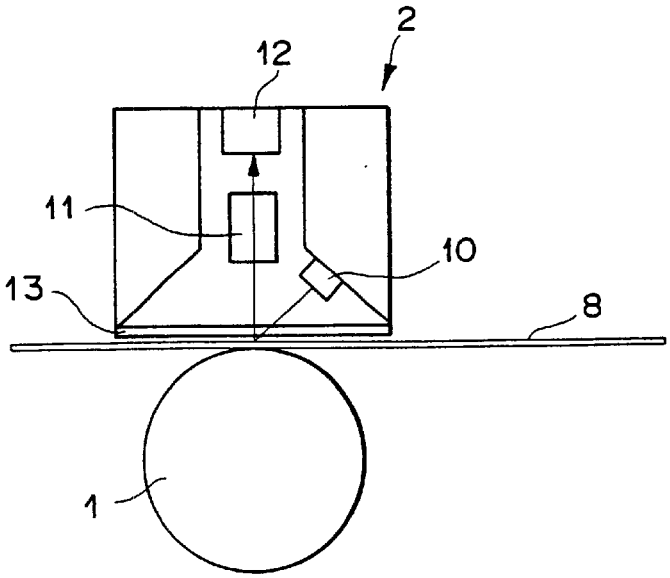
FIG. 2 is a sectional view of the stencil making apparatus taken substantially along line A—A of FIG. 1.
Figure 3:
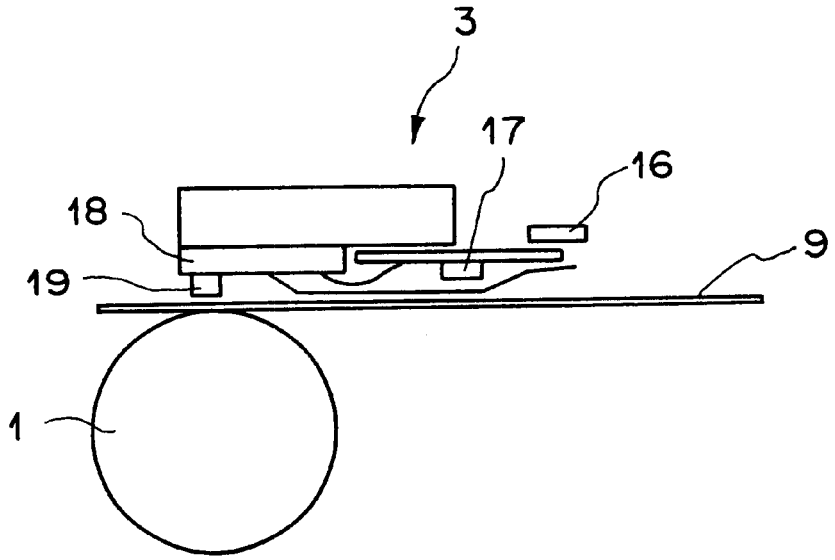
FIG. 3 is a sectional view of the stencil making apparatus taken substantially along line B—B of FIG. 1.

The reading means 2 includes a light source 10, a lens 11, an image sensor 12, and a glass 13, as shown in FIG. 2. The printed-circuit board 4 includes an image processing section 14 and a control section 15. The stencil making means 3 includes a connector 16, a driver integrated circuit (IC) 17, a ceramic board 18, and a thermal head 19, as shown in FIG. 3. The light source 10, the lens 11, and the image sensor 12 are each provided to extend in line form over the entire longitudinal length of the reading means 2. Likewise, the thermal head 19 is provided to extend in line form over the entire longitudinal length of the stencil making means 3.

The reading means 2 and the stencil making means 3 are provided such that they are pushed against the conveyor roller 1 with different predetermined pressures, respectively. The conveyor roller 1 and the pulse motor 5 are connected via a gear 20.

Figure 4:
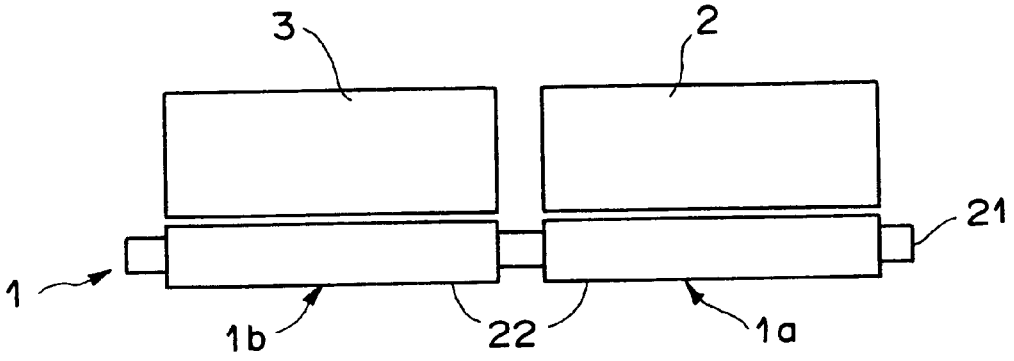
FIG. 4 is a front view showing the conveyor roller shown in FIG. 1.

As shown in FIG. 4, an iron core 21 is positioned at the center of the conveyor roller 1 and covered with an elastic body 22. The elastic body 22 covering the iron core 21 can employ rubber or synthetic resin mixed with rubber, but is not limited to these materials. A different type of elastic means can be used, if it can ensure suitable pressure between itself and the reading means 2 and between itself and the stencil making means 3. Although the reading means 2 and the stencil making means 3 are pushed against the conveyor roller 1 with pressures suitable for original reading and stencil making, the pressure on the side of the stencil making means 3 is usually greater than that on the side of the reading means 2. Therefore, when the conveyor roller 1 is uniform in structure or material, the contraction amount of the elastic body 22 varies between the reading-means corresponding portion 1*a* of the conveyor roller 1 against which the reading means 2 is pushed and the stencil-making-means corresponding portion 1*b* of the conveyor roller 1 against which the stencil making means 3 is pushed, since the pressure varies between the reading-means corresponding portion 1*a* and the stencil-making-means corresponding portion 1*b*. As a result, the diameters of the reading-means corresponding portion 1*a* and the stencil-making-means corresponding portion 1*b* differ and therefore the speeds of conveying an original 8 and a stencil sheet 9 differ, resulting in inaccurate stencil making. For this reason, there is a need to vary the structure, material or the like of the elastic body 22 on the conveyor roller 1 so that the diameters of the conveyor roller 1 become the same between the reading-means corresponding portion 1*a* and the stencil-making-means corresponding portion 1*b* when the read means 2 and the stencil making means 3 are pushed against the roller 1.

To make adjustments so that the diameters of the conveyor roller 1 are the same when the read means 2 and the stencil making means 3 are pushed against the roller 1, it is possible to vary, as appropriate, the material, thickness, hardness, outside diameter and the like of the elastic body 22 which are the constituent elements of the conveyor roller 1. For instance, when rubber is used in the elastic body 22, the rubber hardness of the reading-means corresponding portion 1*a* can be made 30° (measured by a Shore A hardness tester), the outside diameter of the rubber 14.5 mm, and the rubber thickness 2 mm. On the other hand, the rubber hardness of the stencil-making-means corresponding portion 1*b* can be made 40° (likewise measured by the Shore A hardness tester), the outside diameter of the rubber 14.0 mm, and the rubber thickness 3 mm. Since this is merely an example, the present invention is not limited to this. Because the outside diameter of rubber is varied by the magnitude of the pressure produced when the conveyor roller 1 is pushed by the reading means 2 and the stencil making means 3, it is possible to adjust, as appropriate, the material, thickness, hardness, outside diameter and the like of the elastic body 22, respectively, in such a manner that the diameters of the conveyor roller 1 are the same between the read means 2 and the stencil making means 3 when pushed with pressure. It is also possible to change not only the elastic body 22 but also the diameter of the iron core 21. Furthermore, the outside diameters of the conveyor roller 1 can be made the same by changing the other various constituent elements of the conveyor roller 1, depending upon the structure of the conveyor roller 1.

Figure 5:
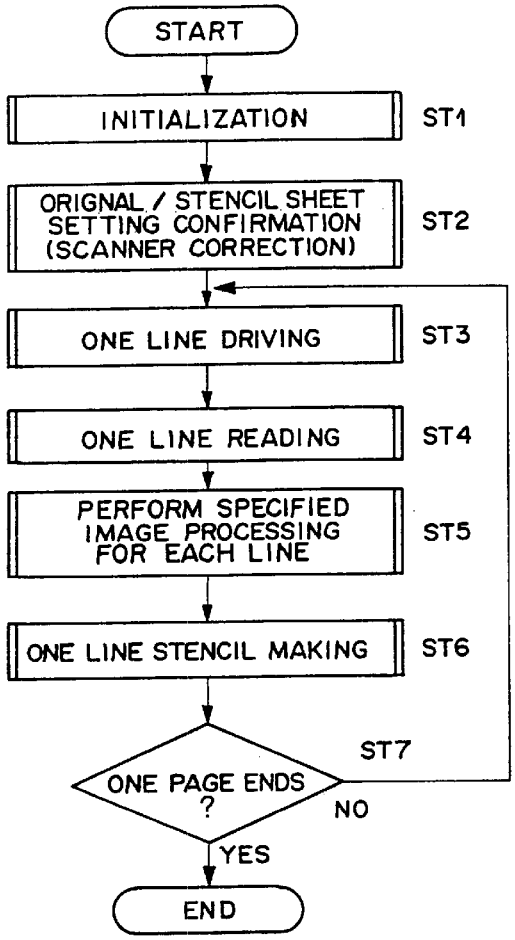
FIG. 5 is a flow diagram used to explain the operation of the stencil making apparatus shown in FIG. 1.
Figure 6:
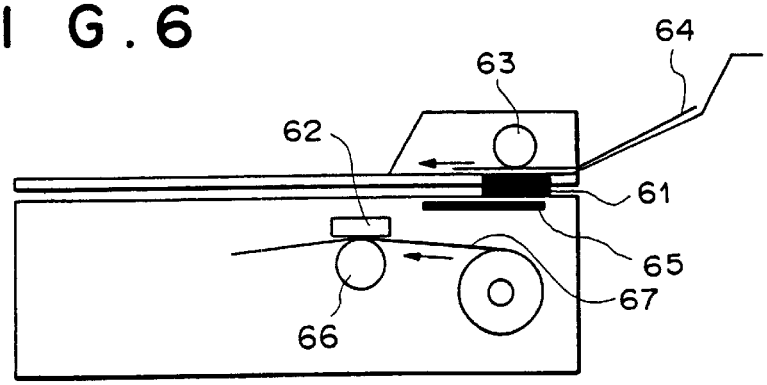
FIG. 6 is a schematic diagram showing a conventional stencil printer with a stencil making apparatus.

Next, the operation of the stencil making apparatus of the present invention will be described with reference to a flow diagram of FIG. 5.

In performing stencil making, the initialization of the apparatus is first performed (ST1). Then, if it is confirmed that the original 8 has been set at a fixed position between the reading means 2 and the conveyor roller 1 and the stencil sheet 9 at a fixed position between the stencil making means 3 and the conveyor roller 1 (ST2), the conveyor roller 1 is driven to rotate by an amount of 1 line by the pulse motor 5, whereby the original 8 and the stencil sheet 9 are conveyed in the direction of arrow X by the same amount (ST3). In this condition, the original 8 is first read by an amount of 1 line by the reading means 2 (ST4). Light is emitted from the light source 10 to the original 8, and the reflected light from the original 8 passes through the glass 13 and the lens 11 and is incident on the image sensor 12 having light-receiving elements arrayed in line form. The incident light is converted to an electrical signal (read data) by the image sensor 12. In this way, 1 line of the original 8 is read.

The electrical signal for an amount of 1 line of the original 8 obtained by the image sensor is converted to multiple-valued data. In the image processing section 14 provided on the printed-circuit board 4, the multiple-valued data is binarized by a method such as error diffusion, mesh-point processing, and simple binary, and is sent to the stencil making means 3 (ST5). Based on this amount of 1 line of data, the stencil making means 3 heats the heating element of the thermal head 19 individually and selectively, whereby the stencil sheet 9 is perforated to make a perforated stencil sheet (ST6).

If amounts of 1 line of original reading and stencil perforating are completed, whether or not an amount of 1 page of the original 8 has ended is checked (ST7). If "NO," the control section 15 further drives the conveyor roller 1 by an amount of 1 line to move the original 8 and the stencil sheet 9 in the direction of arrow X by an amount of 1 line, and the above-mentioned amounts of 1 line of original reading, image processing, and stencil perforating are continued. On the other hand, if "YES," this processing ends. In this way, an amount of 1 page of perforated stencil sheet is made.

In a stencil printer incorporated with the stencil making apparatus of the present invention, the perforated stencil sheet is wound around the outer peripheral surface of a printing drum in a printing section, and the printing drum is driven to rotate. In synchronization with the rotation and at predetermined timing, printing paper is fed from a paper feeding section between the printing drum and a press roller. The printing paper is pushed against the perforated stencil sheet on the printing drum, whereby stencil printing is performed on the printing paper.

While the present invention has been described with reference to the preferred embodiment thereof, the invention is not limited to the details given herein, but may be modified within the scope of the appended claims.

What is claimed is:

1. A stencil making apparatus comprising:

reading means having an image sensor which reads an original to obtain an image data, image processing means which inputs and processes the image data thus obtained by the reading means, stencil making means which thermally perforates a stencil sheet based on the data processed by the image processing means, and a conveyor roller which conveys the original and the stencil sheet, wherein the reading means and the stencil making means are juxtaposed on the conveyor roller and are physically independent from one another, and the conveyance of the original through the reading means and the conveyance of the stencil sheet through the stencil making means are performed by the conveyor roller, and wherein the reading of the original and the making of a stencil are preformed at the same time.

2. A stencil making apparatus comprising:

reading means having an image sensor which reads an original to obtain an image data, image processing means which inouts and processes the image data thus obtained by the reading means, stencil making means which thermally perforates a stencil sheet based on the data processed by the image processing means, and a conveyor roller which conveys the original and the stencil sheet, wherein the reading means and the stencil making means are juxtaposed on the conveyor roller, and the conveyance of the original through the reading means and the conveyance of the stencil sheet through the stencil making means are preformed by the conveyor roller, wherein the reading means and the stencil making means are preformed by the conveyor roller at different pressures.

3. The stencil making apparatus as defined in claim 2 in which a reading-means corresponding portion of the conveyor roller which is pushed against the reading means and a stencil-making-means corresponding portion of the conveyor roller which is pushed against the stencil making means differ in their constituent elements so that the original and the stencil sheet can be conveyed at the same speed.

4. The stencil making apparatus as defined in claim 2 in which a reading-means corresponding portion of the conveyor roller which is pushed against the reading means and a stencil-making-means corresponding portion of the conveyor roller which is pushed against the stencil making means differ in material so that the original and the stencil sheet can be conveyed at the same speed.

5. The stencil making apparatus as defined in claim 2 in which a reading-means corresponding portion of the conveyor roller which is pushed against the reading means and a stencil-making-means corresponding portion of the conveyor roller which is pushed against the stencil making means differ in diameter so that the original and the stencil sheet can be conveyed at the same speed.

6. A stencil making method comprising the steps of:

obtaining an image data of an original using a reading means having an image sensor, processing the image data obtained by the reading means using an image processing means, perforating a stencil sheet based on the data processed by the image processing means using a stencil making means, and conveying the original and the stencil sheet via a conveyor roller as the reading means and the stencil making means are being juxtaposed on the conveyor, wherein the obtaining of the image data and the preforming of a stencil sheet are preformed at the same time.

7. A stencil making method comprising the steps of:

obtaining an image data of an original using a reading means having an image sensor, processing the image data obtained by the reading means using an image processing means, perforating a stencil sheet based on the data processed by the image processing means using a stencil making means, and conveying the original and the stencil sheet via a conveyor roller as the reading means and the stencil making means are being juxtaposed on the conveyor, wherein the conveying the original and the stencil sheet via a conveyor roller further comprises the reading means and the stencil making means being pushed against the conveyor roller at a different pressure.

* * * * *